US006722065B2

(12) United States Patent
Schmitt

(10) Patent No.: US 6,722,065 B2
(45) Date of Patent: Apr. 20, 2004

(54) ILLUMINATED INDICIA ENCLOSURES

(75) Inventor: David Schmitt, Hastings, MN (US)

(73) Assignee: Gemini, Inc., Cannon Falls, MN (US)

( * ) Notice: Subject to any disclaimer, the term of this patent is extended or adjusted under 35 U.S.C. 154(b) by 18 days.

(21) Appl. No.: 09/999,821

(22) Filed: Oct. 31, 2001

(65) Prior Publication Data

US 2003/0079388 A1 May 1, 2003

(51) Int. Cl.[7] ..... G09F 13/00
(52) U.S. Cl. ..... 40/552; 40/574
(58) Field of Search ..... 40/552, 574, 564

(56) References Cited

U.S. PATENT DOCUMENTS

| | | | | | |
|---|---|---|---|---|---|
| 2,114,550 | A | * | 4/1938 | Vandermeer | 40/552 |
| 2,524,294 | A | * | 10/1950 | Marsh | 40/552 |
| 2,847,781 | A | * | 8/1958 | Van Den Berg | 40/564 |
| 3,593,447 | A | * | 7/1971 | Winegarten | 40/564 |
| 4,088,881 | A | * | 5/1978 | Neer et al. | 40/574 X |
| 4,267,657 | A | * | 5/1981 | Kloke | 40/574 X |
| 4,272,901 | A | * | 6/1981 | Matthews | 40/574 |
| 4,380,880 | A | | 4/1983 | Gandy | 40/564 |
| 4,387,522 | A | | 6/1983 | Sommers-Szoszky | 40/576 |
| 4,701,991 | A | | 10/1987 | Scheffer, Sr. | |
| 4,759,143 | A | * | 7/1988 | Pommerleau | 40/574 |
| 4,873,776 | A | | 10/1989 | Hoffart | 40/572 |
| 4,887,195 | A | * | 12/1989 | Donelan | 40/574 X |
| 4,905,390 | A | | 3/1990 | Stilling | 40/549 |
| 5,301,447 | A | * | 4/1994 | Lotter et al. | 40/574 X |
| 5,347,736 | A | | 9/1994 | Kanigan | 40/576 |
| 5,381,324 | A | | 1/1995 | Hillstrom et al. | 40/577 X |
| 5,444,931 | A | * | 8/1995 | Hillstrom | 40/574 X |
| 5,613,763 | A | | 3/1997 | Hillstrom et al. | 362/812 X |
| 5,644,860 | A | | 7/1997 | Piper et al. | 40/579 |
| 5,746,503 | A | | 5/1998 | Hillstrom et al. | 362/812 X |
| RE36,039 | E | | 1/1999 | Hillstrom et al. | 40/577 X |
| 5,931,564 | A | | 8/1999 | Hillstrom et al. | |
| 6,123,442 | A | | 9/2000 | Freier et al. | 40/547 X |
| 6,154,994 | A | | 12/2000 | O'Brien et al. | 40/575 |
| 6,174,065 | B1 | | 1/2001 | Schurch | 362/812 X |
| 6,202,333 | B1 | | 3/2001 | Grate et al. | 40/575 |

* cited by examiner

*Primary Examiner*—Joanne Silbermann

(57) ABSTRACT

An illuminated indicia enclosure apparatus includes a rear panel fixedly attached to an upstanding surface, the rear panel having apertures disposed therein for receiving and mounting one or more lighting elements on an inner surface thereof, an indicia-defining fascia, the fascia having a front panel and generally opposing side panels extending therefrom, and hinged tension securement elements for securing the fascia to the rear panel, wherein the hinged tension securement elements are configured to provide expedient installment and removal of the fascia to the rear panel.

11 Claims, 3 Drawing Sheets

10
2
14
24
12
22
24
2

14
12
28
24
10
34
32
36
27
36
22
34
30
26
29
24

ILLUMINATED INDICIA ENCLOSURES

FIELD OF THE INVENTION

The present invention related to illuminated indicia generally, and more particularly to means for removably mounting illuminated indicia fascias to support structures. This invention also relates to methods for removably mounting and dismounting illuminated indicia enclosures to respective mounting structures.

BACKGROUND OF THE INVENTION

Illuminated indicia, including letters, numbers, and symbols, having long been used in the art to display various messages. Often times, such messages convey advertising information, as well as brand identity information. A wide variety of applications for such illuminated indicia, however, continue to be contemplated in the art.

A number of different designs for illuminated indicia have been implemented in the art. For example, back-lit enclosures having a translucent front face configured to receive indicia stencils thereon, such that light passes through only selected areas of the translucent front face to transmit the desired light pattern. In other configurations, the translucent front face is designed to receive substantially opaque indicia thereon, whereby the light enclosure itself is illuminated so that viewers may perceive the opaque indicia as desired messages. Such illuminated signs tend to be relatively small, and have limited effectiveness in prominently displaying the desired messages in a stylized manner. In addition, such back-lit signs tend to be of relatively complex construction, whereby widespread use on large illuminated displays is inefficient.

In response to such shortcomings, individual illuminated indicia have been developed. Illuminated indicia typically contain individual distinct lighting elements disposed therewithin for independently illuminating each indicia forming the desired message. Individually illuminated indicia generally provide enhanced viewability and styling by being configured in customized three-dimensional shapes. In addition, customized styling of the displayed indicia is made possible by the individual distinct lighting element characteristic of channel indicia.

A particular advantage achieved through the use of individually illuminated indicia is the enhanced prominence and visibility of such indicia via fully translucent three-dimensional shapes. Such three-dimensional shapes may incorporate one or more colors or light emission patterns to further enhance styling of the illuminated indicia.

Though such illuminated indicia have many advantages in displaying desired information, the manufacture, installation, and service of such indicia has heretofore been complex and expensive. Therefore, individually illuminated indicia have been implemented with caution and some limitation, in that servicing of such indicia has traditionally required significant time and expense. Most typically, lighting elements disposed within indicia have had to be accessed for servicing from behind a mounting surface thereof. A common example where such illuminated indicia have been used is in overhead canopies, such as those employed at fuel stations. In the past, lighting elements in need of servicing required a service technician to physically maneuver within the canopy, or to completely disassemble the attached indicia, both of which are time consuming, difficult, and expensive. Furthermore, installation of such illuminated indicia has traditionally been a time-consuming process that limited the widespread applicability of individually illuminated indicia.

It is therefore a principle object of the present invention to provide a means for quickly and easily mounting and dismounting individually illuminated indicia to respective mounting structures for efficient indicia installment and lighting element servicing.

It is a further object of the present invention to provide individually illuminated indicia having hinged tension securement means for removably securing the illuminated indicia to a support therefor.

It is another object of the present invention to provide a hinged tension securement means for removably securing illuminated indicia to a corresponding support structure, wherein the hinged tension securement means minimizes visual identification of securing elements.

It is a yet further object of the present invention to provide a hinged coupling means for operably securing an individually illuminated indicia to a support therefore, wherein the hinged coupling means provides efficient installment and removal of the illuminated indicia from the corresponding support structure.

It is a yet further object of the present invention to provide a hinged tension securement means which minimizes use of fasteners to effect securement between an illuminated indicia and a support structure therefore.

It is a yet further object of the present invention to provide a method for quickly mounting and dismounting illuminated indicia to a mounting structure, wherein the illuminated indicia is a polymeric material.

SUMMARY OF THE INVENTION

By means of the present invention, an improved illuminated indicia enclosure apparatus is provided for expeditious assembly and disassembly. The illuminated indicia of the present invention further provides a seamless "integrated" appearance that minimizes visual identification of securing elements that secure the illuminated indicia enclosure to a respective support structure. A hinged tension securement means is provided in the present invention for efficiently removably securing the indicia enclosure to a corresponding support structure, the hinged tension securement means further providing easy access to lighting elements disposed therewithin.

One embodiment of the illuminated indicia enclosure includes a rear panel fixedly attached to an upstanding surface, the rear panel having apertures disposed therein for receiving and mounting one or more lighting elements on an inner surface thereof, an upper portion of the rear panel having a mounting flange extending generally away from the upstanding surface, the mounting flange having a substantially vertically-oriented aperture disposed therein, and a lower portion of the rear panel having a downwardly-depending tab portion spaced from the upstanding surface. The illuminated indicia enclosure further includes an indicia-defining fascia, the fascia having a front panel and generally opposing side panels extending therefrom, wherein a distal end of a lower portion of the side panels has an upwardly-depending tab portion hingedly coupled with the downwardly-depending tab portion of the rear panel. An upper portion of the fascia includes a mounting aperture disposed therein, the mounting aperture being operably aligned with the aperture in the mounting flange for receiving one or more fasteners therethrough. The hingedly coupled tab portions and the fastened flange, in combination, forms a hinged tension securement means for expedient installment and removal of the fascia from the rear panel. Preferably, therefore, the fascia is tension-fitted onto the rear panel. Preferably, the mounting flange aperture includes a fixed threaded nut disposed therein for threadably receiving threaded fasteners therethrough. The enclosure apparatus is preferably a polymeric material, and is at least partially translucent.

Another embodiment of the illuminated indicia enclosure apparatus includes a rear panel fixedly attached to an upstanding surface, the rear panel having apertures disposed therein for receiving and mounting one or more lighting elements on an inner surface thereof, and an indicia-defining fascia, wherein the fascia has a front panel and generally opposing side panels extending therefrom. The enclosure apparatus further includes hinged tension securement means for removably securing the fascia to the rear panel, wherein the hinged tension securement means is configured to provide expedient installment and removal of the fascia to the rear panel. Preferably, the hinged tension securement means includes a hinge means disposed at a lower portion of the enclosure, the hinge means comprising respective generally opposing hinge tab portions of the rear panel and the fascia, wherein the tab portions are operably maintained in intimate contact with one another by tension forces developed through securement of the fascia to the rear panel. The hinge means preferably includes beveled surfaces, and may additionally or alternatively include radiused surfaces.

The present invention also contemplates a method for quickly mounting and dismounting a fascia portion of an illuminated indicia enclosure apparatus to a mounting structure. The method includes fixedly attaching the fascia portion to the mounting structure, the mounting structure having apertures disposed therein for receiving one or more lighting elements on an inner surface thereof, the upper portion of the mounting structure having a mounting flange extending generally outwardly from the mounting structure, wherein the mounting flange has an aperture disposed therein, the mounting structure further includes a lower portion having a downwardly-depending tab portion extending therefrom. The method further includes engaging an upwardly-depending tab portion of a lower portion of the fascia to the downwardly-depending tab portion to thereby form a hinged relationship therebetween, and rotatably aligning the fascia on the mounting structure to thereby form a tensioned securement between the fascia and the mounting structure at the mounting flange. The method continues by inserting a fastener through respective aligned apertures of the fascia and the mounting flange of the mounting structure to thereby removably secure the fascia to the mounting structure.

DETAILED DESCRIPTION OF THE PREFERRED EMBODIMENTS

The objects and advantages enumerated above together with other objects, features, and advances represented by the present invention will now be presented in terms of detailed embodiments described with reference to the attached drawing figures which are intended to be representative of various possible configurations of the invention. Other embodiments and aspects of the invention are recognized as being within the grasp of those having ordinary skill in the art.

Figure 1:
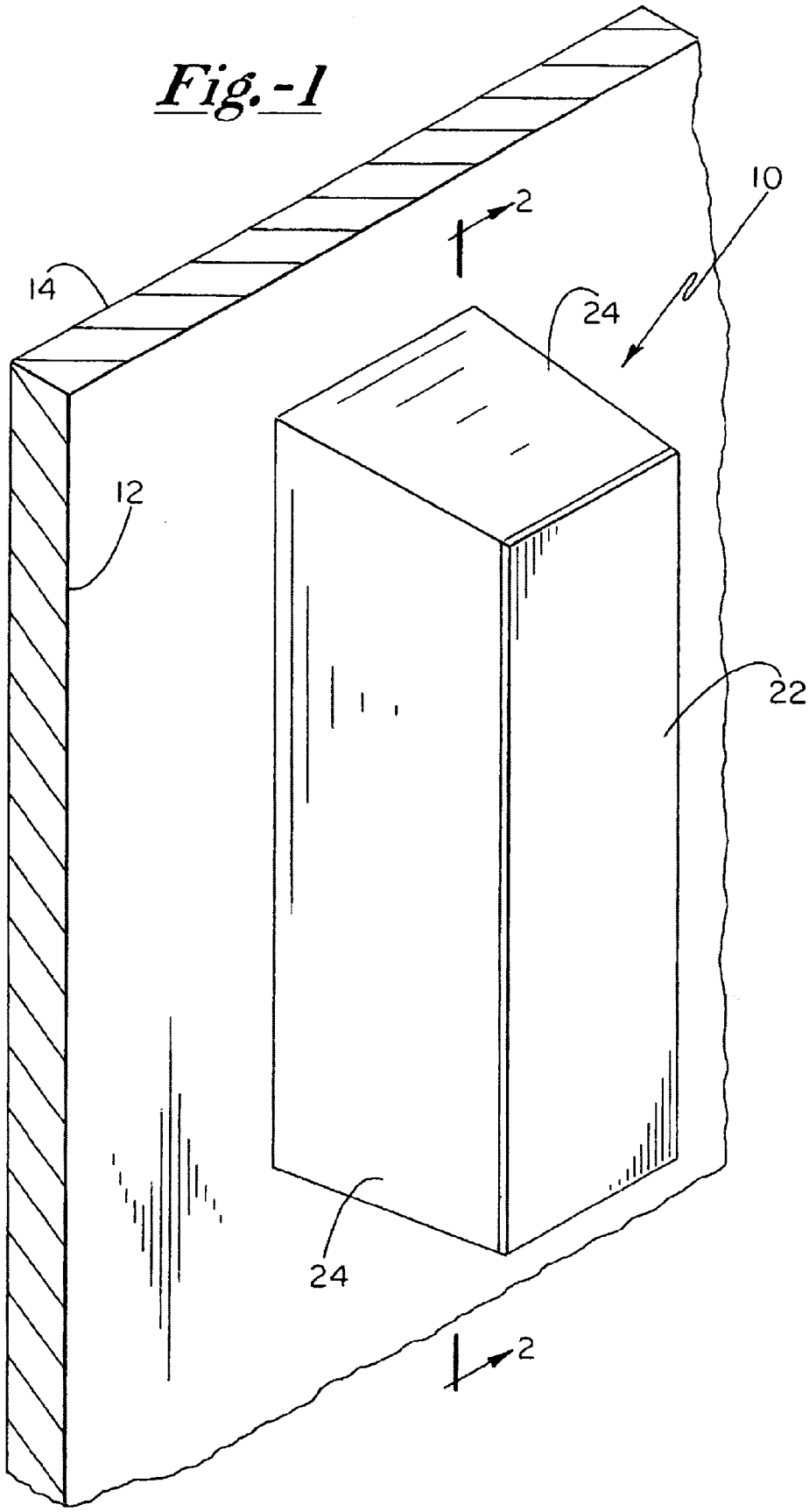
FIG. 1 is a perspective view of an illuminated indicia enclosure of the present invention.

Referring now by characters of reference to the drawings, and first to FIG. 1, an illuminated indicia 10 is shown mounted to an upstanding surface 12 of a related structure 14. Structure 14 may include, for example, a freestanding sign board, a wall, or an illuminated canopy structure as typically used at service stations or the like. In preferred embodiments, a plurality of illuminated indicia are used in combination with one another to convey information or messages. Illuminated indicia 10 is preferably styled and configured to be readily perceived in both day and night light conditions.

Figure 2:
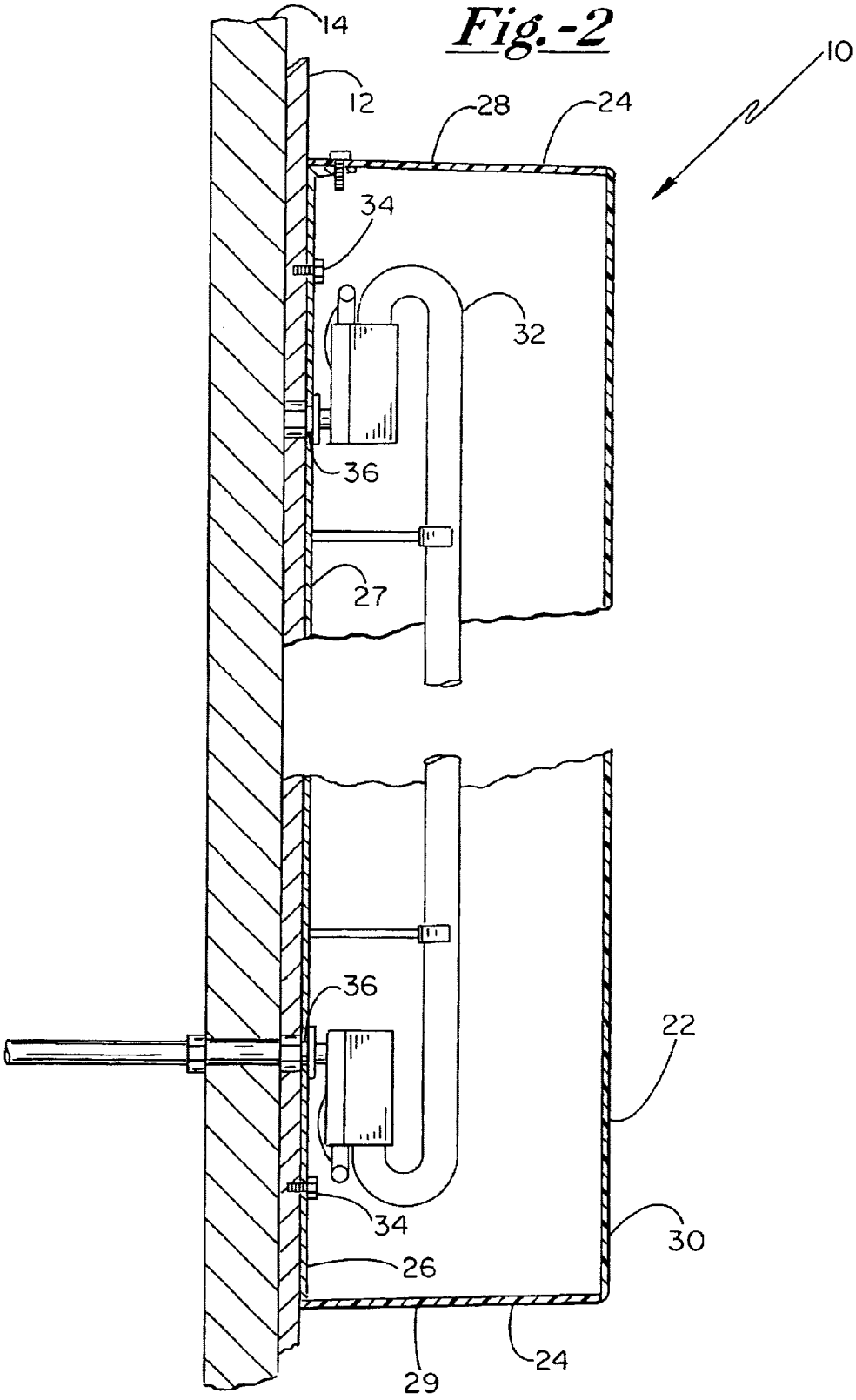
FIG. 2 is a cross-sectional side view as taken along cut-line 2—2 of FIG. 1.

Illuminated indicia 10 preferably includes a front panel 22 and generally opposing side panels 24 extending from front panel 22 to a rear panel 26 (as shown in FIG. 2). In some embodiments, side panels 24 extend substantially perpendicularly from front panel 22 to rear panel 26. In other embodiments, however, upper portion 28 and lower portion 29 of side panels 24 are mounted to rear panel 26 in a tensioned configuration, whereby resilient side panels 24 are "stretched" into place, and correspondingly conform to a somewhat non-perpendicular configuration.

Illuminated indicia 10 may be fabricated from a variety of materials, though weather-resistant materials are preferred when such indicia 10 are utilized in outdoor environments. Preferably, illuminated indicia 10 is fabricated from a polymeric material, such as polycarbonate. The polymeric material is preferably utilized in the manufacture of front panel 22 and side panels 24. In some embodiments, rear panel 26 may also be fabricated from a polymeric material. Depending on the application, the polymeric material used in the respective panels are at least partially translucent. In some embodiments, front panel 22 is translucent while side panels 24 are opaque. In other embodiments, front panel 22 and side panels 24 are translucent. Preferably, one or more of such panels are translucent to transmit light emitting from one or more light elements 32 disposed within indicia 10.

Though the use of polymeric materials for indicia 10 is preferred, other materials may be similarly incorporated therein. For example, front panel 22 may comprise a polymeric material such as polyethylene, while side panels 24 are a metal such as aluminum. Preferably, however, side panels 24, and particularly upper portion 28 and lower portion 29 of side panels 24, are somewhat resilient. Such a resilient characteristic allows a tensioned fitting of side panels 24 onto rear panel 26.

Side panels 24 are preferably distinct pieces that are attached to front panel 22 to form a sub-assembly, or fascia. Side panels 24 are preferably adhesively connected to front panel 22 to form such a fascia. In other embodiments, front panel 22 and side panels 24 are integrally formed as a single fascia unit.

With attention now being drawn to FIG. 2, a cross-sectional side view of indicia 10 is shown. Front panel 22 and side panels 24, in combination, form an indicia-defining fascia 30 which may be tension-mounted onto rear panel 26. Fascia 30 may also be removably secured to rear panel 26 in a non-stretched configuration, wherein tension fascia 30 to rear panel 26 are minimal. As shown in FIG. 2, rear panel 26 is preferably fixedly attached to upstanding surface 12 of structure 14 via one or more fasteners 34. Rear panel 26 is preferably positioned on upstanding surface 12 prior to mounting fascia 30 thereto. Rear panel 26 preferably includes one or more apertures 36 disposed therein for receiving and mounting one or more lighting elements 32 to an inner surface 27 of rear panel 26. Lighting element 32 is preferably a tubular gaseous lighting fixture, though various types of lighting device 32 may be utilized. In particular, neon lighting devices are particularly preferred for desired illumination characteristics.

Figure 3:
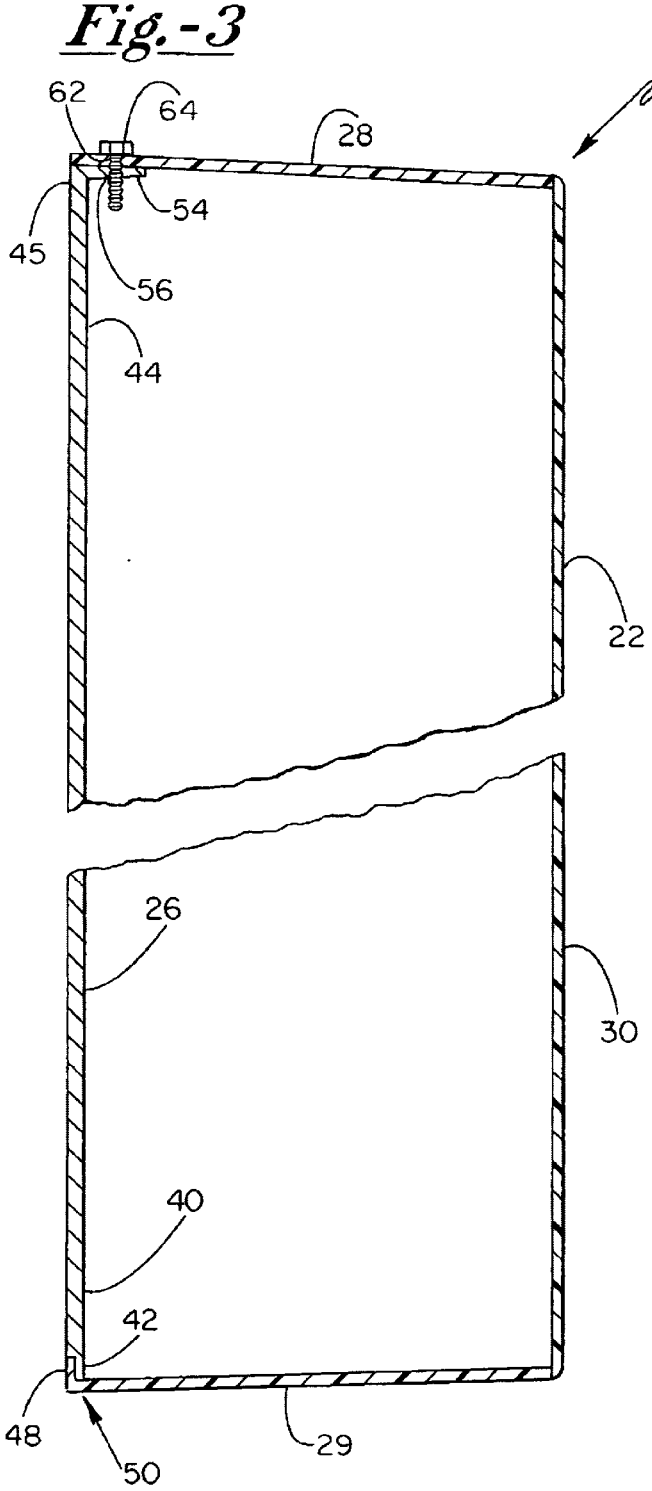
FIG. 3 is a isolation cross-sectional side view of an illuminated indicia enclosure in accordance with the present invention.
Figure 4:
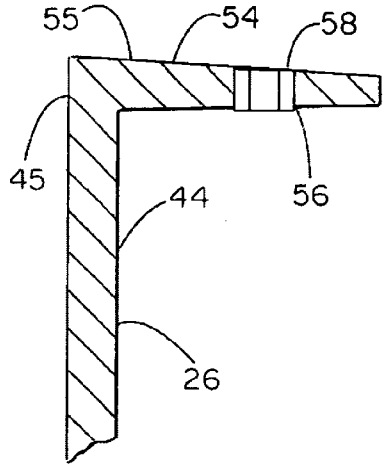
FIG. 4 is an enlarged view of the upper portion of a mounting structure in accordance with the present invention.
Figure 5:
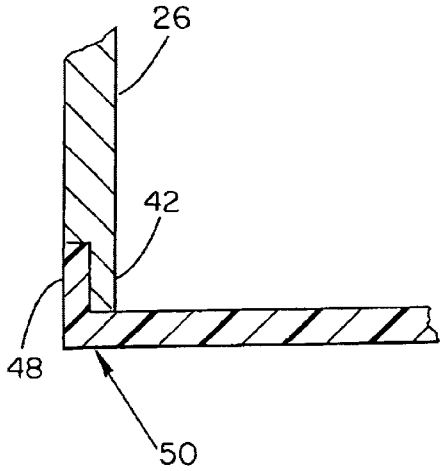
FIG. 5 is an enlarged side view of a hinge coupling means in accordance with the present invention.

Fascia 30 is preferably removably mounted onto rear panel 26 via a hinged tension means which may more easily be seen in FIGS. 3–5. In preferred embodiments, a lower portion 40 of rear panel 26 includes a downwardly depending tab portion 42 that is spaced from surface 12. The corresponding lower portion 29 of fascia 30 preferably includes an upwardly-depending tab portion 48 which operably engages with tab portion 42 of rear panel 26. When engaged with one another, respective tab portions 42, 48 operably form a hinge means 50 for rotatably securing fascia 30 to rear panel 26. Upwardly depending tab portion 48 is preferably insertably engaged with tab portion 42 such that respective surfaces thereof are substantially in intimate contact with one another. In such a manner, upward and horizontal movement of fascia 30 with respect to rear panel 26 is substantially arrested via hinge means 50.

Rear panel 26 preferably includes a mounting flange 54 disposed at an upper portion 44 thereof. In preferred embodiments, mounting flange 54 extends substantially perpendicularly outwardly from upper portion 44 of rear panel 26 at an upper end 45 of rear panel 26. Preferably, mounting flange 54 includes an aperture 56 disposed therein, which aperture 56 is preferably substantially vertically-oriented through an entire thickness of mounting flange 54. Correspondingly, upper portion 28 of fascia 30 preferably includes an aperture 62 disposed therein, which aperture 62 is operably aligned with aperture 56 in mounting flange 54. When fascia 30 is mounted in proper position, a fastener 64 is inserted through respective apertures 62, 56 to thereby removably secure fascia 30 to rear panel 26. As shown in FIG. 4, mounting flange 54 preferably includes a fixed threaded nut 58 substantially disposed in aperture 56. Nut 58 is preferably fixed in place in mounting flange 54, such that fastener 64 may be threadably received therethrough.

As may be seen in FIG. 3, fascia 30 is preferably fitted onto rear panel 26 so that a single fastener 64 sufficiently secures indicia 10 to surface 12. As such, front panel 22 of fascia 30 may be slightly shorter than the corresponding rear panel 26, such that upper portion 28 and lower portion 29 of side panels 24 must be resiliently "stretched" into the desired mounting position. The resulting slightly trapezoidal configuration of indicia 10 is illustrated in FIG. 3. In preferred embodiments, upper surface 55 of mounting flange 54 is slanted slightly downwardly, whereby upper portion 28 of side panel 24 is aligned in substantially parallel relationship therewith in the slightly trapezoidal configuration. Preferably, the slant angle provided for upper surface 55 of mounting flange 54 is about two degrees with respect to a perpendicular plane of surface 12. In other embodiments, however, fascia 30 is configured to couple with rear panel 26 without resiliently stretching side panels 24, such that a tensioned fit is unnecessary.

Illuminated indicia 10 is preferably constructed by first fixedly attaching rear panel 26 to upstanding surface 12 of structure 14 via one or more fasteners 34. Other means of fixedly attaching rear panel 26 to surface 12 are contemplated by the present invention, including adhesives, welding, and soldering. In other embodiments, rear panel 26 may be integrally formed with upstanding surface 12 of structure 14. Lighting element 32 is preferably then mounted in position on rear panel 26 for desired illumination of indicia 10. Fascia 30 is preferably constructed by adhesively attaching side panels 24 to front panel 22. Other means for attaching side panels 24 to front panel 22 are also contemplated by the present invention, including fastening means such as screws and the like. Fascia 30 may also be integrally formed as a single unit so that construction thereof is not required. Fascia 30 is preferably positioned such that upwardly-depending tab portion 48 of lower portion 29 is insertably engaged between downwardly-depending tab portion 42 and surface 12. Such an engagement creates a hinge means 50, whereby fascia 30 may be directed upwardly and outwardly so that upper portion 28 may be positioned on an upper surface 55 of mounting flange 54. Fascia 30 is preferably positioned so that respective apertures 56, 62 are operably aligned for threadably receiving fastener 64 therethrough. Other means for removably securing upper portion 28 of fascia 30 to mounting flange 54 are also contemplated by the present invention, including integrated snap elements, hooks, or other configurations not requiring separate fasteners. In such a manner, a hinged tension securement means removably securing fascia 30 to rear panel 26 is created.

As illustrated in FIG. 5, respective engaged surfaces of tab portions 42, 48 are preferably beveled to provide easier installation, rotation, and removal of fascia 30 with respect to rear panel 26. The engaged respective surfaces may instead be radiused, or any other configuration which aids in the operability of hinge means 50.

A number of advantages over the existing art are introduced by the indicia enclosure apparatus of the present invention. The hinged securement means provided by the engaged tab portions 42, 48 allow expeditious and simple installation and removal of fascia 30 to rear panel 26. Through the use of the illuminated indicia enclosure of the present invention, technicians can install and remove fascia 30 with very little effort. Since connection between a proportion 28 of fascia 30 and mounting flange 54 may be accomplished either through a fastener or integrated hook or other "capturing" means, fascia 30 may be removed with little effort for easy access and repair to lighting element 32. As stated above, a variety of removable attachment means between upper portion 28 and mounting flange 54 are contemplated by the present invention, including those not requiring separate fastening elements.

An additional advantage provided by the present invention is a substantially "seamless" engagement of fascia 30 to rear panel 26. Since illuminated indicia 10 are often times mounted on elevated surfaces, upper portion 28 of side panel 24 is not visible from ground level. Therefore, the nested hinge configuration of hinge means 50 provides the appearance of a solid indicia construction. Such a seamless or solid appearance is desirable for professional-grade equipment. Therefore, a unitary indicia structure appearance is provided, while maintaining and providing quick and easy access to the interior of indicia 10.

The invention has been described herein in considerable detail in order to comply with the patent statutes, and to provide those skilled in the art with the information needed to apply the novel principles and to construct and use embodiments of the invention as required. However, it is to be understood that the invention can be carried out by specifically different devices and that various modifications can be accomplished without departing from the scope of the invention itself.

What is claimed is:

1. An illuminated indicia enclosure apparatus, comprising:

(a) a rear panel fixedly attached to an upstanding surface, said rear panel having apertures disposed therein for receiving and operably mounting one or more lighting elements on an inner surface thereof, an upper portion of said rear panel having a first mounting flange extending substantially along a plane in a direction generally away from the upstanding surface, said first mounting flange having an upper surface and a generally opposed lower surface, and an aperture extending therethrough between said upper and lower surfaces, and a lower portion of said rear panel having a first downwardly-depending tab portion spaced from said upstanding surface, said first tab portion having a first outer surface being spaced from, and in facing relationship with, the upstanding surface; and (b) an indicia-defining fascia body, said fascia body having a front panel and generally opposing side panels extending therefrom, a distal end of a lower portion of said side panels having a second upwardly-depending tab portion that is specifically configured to operably and matingly engage with said first tab portion of said rear panel by operably extending between said first outer surface of said first tab portion and the upstanding surface, and a mounting aperture disposed in an upper portion of said side panels, said upper portion of said side panels being operably positioned on said upper surface of said first mounting flange, such that the mounting aperture in said fascia body is operably aligned with the aperture in said mounting flange for receiving one or more fasteners therethrough, the operably engaged tab portions and the fastened flange, in combination, forming a tension securement means for operably and removably securing said fascia body to said rear panel.

2. An enclosure apparatus as in claim 1 wherein said fascia body is tension fitted onto said rear panel.

3. An enclosure apparatus as in claim 1 wherein said mounting flange aperture includes a fixed threaded nut disposed therein for threadably receiving threaded fasteners therethrough.

4. An enclosure apparatus as in claim 1 wherein said fascia body is a polymeric material.

5. An enclosure apparatus as in claim 1 wherein said front panel of said fascia body is a translucent material.

6. An enclosure apparatus as in claim 1 wherein said front panel and said side panels of said fascia body are translucent.

7. An enclosure apparatus as in claim 1 wherein said side panels are adhesively secured to said front panel.

8. An enclosure apparatus as in claim 1 wherein said side panels are integrally formed with said front panel.

9. A method for quickly mounting and dismounting a fascia body of an illuminated indicia enclosure apparatus to a mounting structure, comprising:

(a) fixedly attaching said mounting structure to an upstanding surface, said mounting structure having apertures disposed therein for receiving one or more lighting elements on an inner surface thereof, an upper portion of said mounting structure having a first mounting flange extending substantially along a plane in a direction generally outwardly from the upstanding surface, said first mounting flange having a connection means disposed thereon, a lower portion of said mounting structure having a first downwardly-depending tab portion having a first outer surface being spaced from, and in facing relationship with, the upstanding surface; and (b) engaging a second upwardly-depending tab portion of a lower portion of said fascia body to said first tab portion by operably inserting said second tab portion between said first outer surface of said first tab portion and the upstanding surface so as to thereby form a hinged relationship therebetween, and rotatably aligning said fascia body into coupling relationship with said connection means on said first mounting flange to thereby form a fitted removable securement between said fascia body and said mounting structure.

10. A method as in claim 9 wherein at least a portion of said fascia body is translucent.

11. A method as in claim 9 wherein said fascia body comprises a front panel and generally opposing side panels attached to, and extending from, said front panel.

* * * * *